US005678824A

United States Patent [19]

Fortier et al.

[11] Patent Number: 5,678,824

[45] Date of Patent: Oct. 21, 1997

[54] PORTABLE TARGET STAND

[76] Inventors: Kelly F. Fortier, 7320 W. Devonshire Ave., Phoenix, Ariz. 85033; Shawn W. Flanders, 10316 W. Catalina, Avondale, Ariz. 85323

[21] Appl. No.: 691,945

[22] Filed: Aug. 5, 1996

[51] Int. Cl.[6] ..... F41J 1/10

[52] U.S. Cl. ..... 273/407; 273/406; 273/400; 273/403; 473/478

[58] Field of Search ..... 273/395, 396, 273/398–402, 406, 407, 411, 26 A; 473/197, 478

[56] References Cited

U.S. PATENT DOCUMENTS

| | | | |
|---|---|---|---|
| 2,048,155 | 7/1936 | Armantrout . | |
| 2,538,118 | 1/1951 | Miller . | |
| 2,722,420 | 11/1955 | Adamson | 273/407 |
| 2,890,051 | 6/1959 | Williams . | |
| 3,087,701 | 4/1963 | Wallace | 273/407 |
| 3,355,174 | 11/1967 | Hutson . | |
| 3,399,889 | 9/1968 | Harry . | |
| 3,836,144 | 9/1974 | Mahoney | 273/26 A |
| 4,457,513 | 7/1984 | Thompson | 273/411 |
| 4,629,188 | 12/1986 | Mahieu | 273/407 |
| 4,650,189 | 3/1987 | Rajacich | 273/395 |
| 4,726,593 | 2/1988 | Wade . | |
| 4,811,956 | 3/1989 | Foreman . | |
| 4,884,658 | 12/1989 | Banfield | 273/407 |
| 4,917,388 | 4/1990 | Marquardt . | |
| 5,209,492 | 5/1993 | Hamilton . | |

FOREIGN PATENT DOCUMENTS

| | | | |
|---|---|---|---|
| 3914168 | 11/1989 | Germany | 273/407 |
| 809806 | 3/1959 | United Kingdom | 273/407 |

*Primary Examiner*—Mark S. Graham

*Attorney, Agent, or Firm*—Parsons & Goltry; Robert A. Parsons; Michael W. Goltry

[57] ABSTRACT

A portable target stand for placement on the ground for supporting a target, the portable target stand comprising a collapsible support defining an unobstructed opening, a plurality of clamps for adjustingly suspending the target within the unobstructed opening in spaced apart relation relative the collapsible support, and a collapsible base operative for holding the collapsible support in a generally upright configuration.

18 Claims, 3 Drawing Sheets

FIG. 5
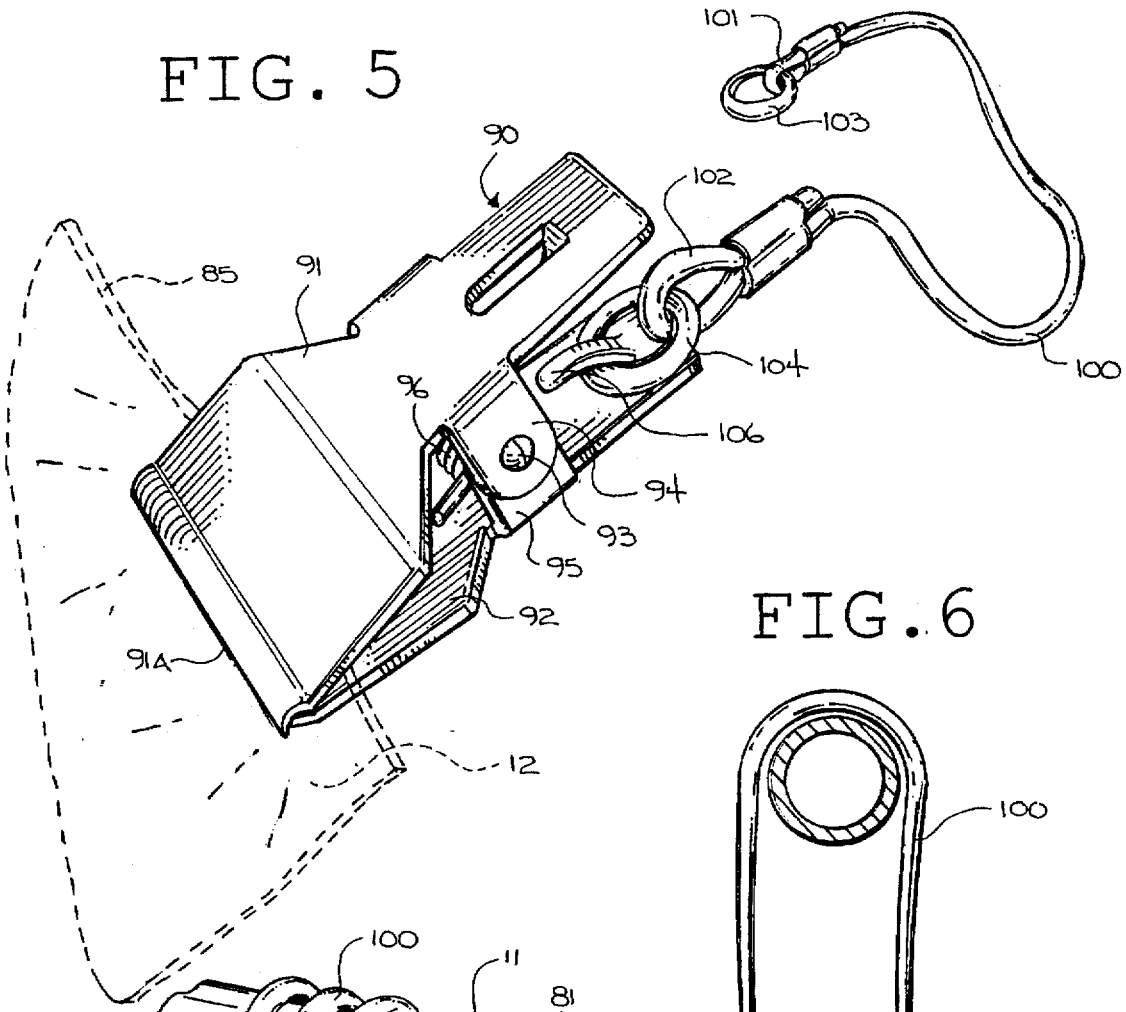
FIG. 6
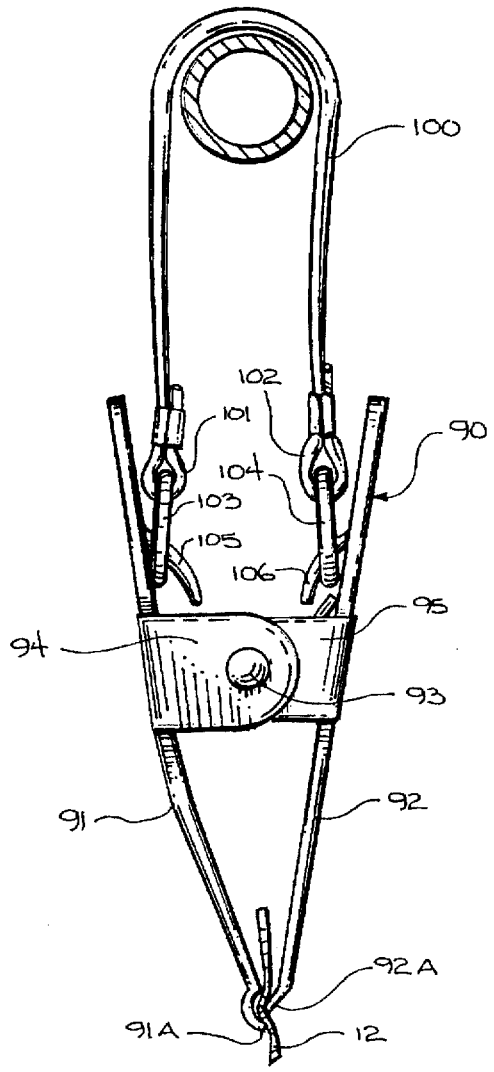
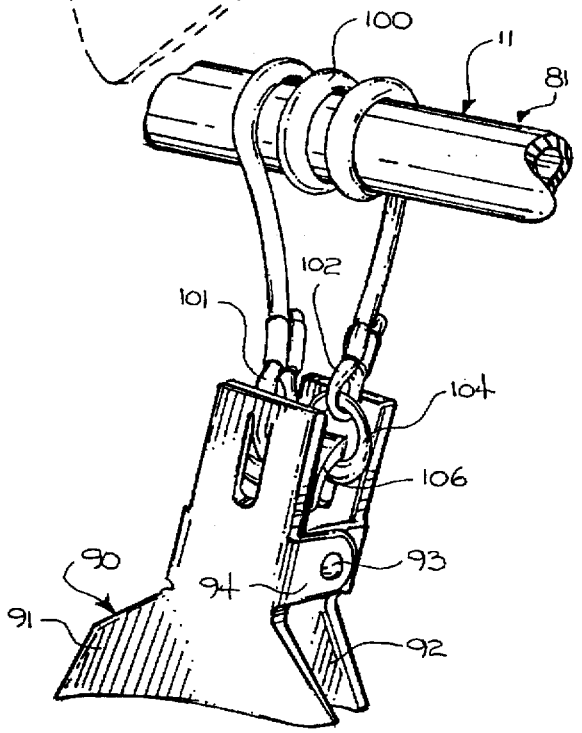
FIG. 7

PORTABLE TARGET STAND

BACKGROUND OF THE INVENTION

1. Field of the Invention

This invention relates to target shooting.

More particularly, this invention relates to devices for suspending a target to be shot.

In a further and more specific aspect, the instant invention relates to a portable target stand for suspending a target to be shot.

2. Prior Art

Target shooting is normally defined as the sport of firing a projectile, such as a bullet or an arrow, at targets of various kinds with rifles, handguns, shotguns, and/or a bow and arrow. Shooting at a target as a test of skill has its origins with archery, and it was not until much later, after the advent of firearms, that target shooting with firearms became commonplace. Today, target shooting is a very popular and competitive activity.

Target shooting can involve shooting at either moving targets or stationary targets. With respect to stationary targets, a target is placed at a distance, shot at a number of times, and then removed and replaced with another target. Normally, the target needs to be supported or suspended above the ground so that it may be shot. Accordingly, the prior art has provided an array of apparatus or stands which may be operative for supporting or suspending a target to be shot. However, these apparatus are not easily transported from place to place, are easily damaged during use, and suffer from additional structural shortcomings which necessitate certain new and useful improvements.

For instance, the prior art has provided a target stand having a pair of legs that can be driven into the earth. This target stand also includes a continuous roll of targets mounted on and between the legs for supplying a user with a supply of targets which are successively unrolled and then secured in place for use thereof. In order to hold the target stand rigid, also included are bracing members which interconnect the legs beneath the roll of targets. Although impressive, the bracing members and the roll of targets are easily struck by projectiles which can occasion damage and sometimes even destruction of the target stand. Additionally, because the legs must be driven into the earth for supporting the stand in a substantially upright position, this target stand, and others like it, cannot be used on relatively impenetrable surfaces such as rock, asphalt, or perhaps concrete.

Another known target holder incorporates a continuous frame having a plurality of clamps for holding a target. The frame is adjustable for fitting selected targets. Although exemplary, this apparatus is not easily collapsible, incorporates many small parts which can be lost or misplaced, and can become irreparably damaged from incoming projectiles due to the close proximity between the target and the frame.

Other apparatus incorporate upstanding frameworks which generally include a base having a pair of upstanding legs for supporting a target therebetween. The target can be either rigidly mounted or pivotally mounted, and some of the frameworks are collapsible, incorporating a plurality of fasteners used for erecting the framework as needed. However, these frameworks are not easily assembled and reassembled, normally sustain severe damage from incoming projectiles due to the close proximity of the target to the framework, and incorporate many separate parts which may not be easily repaired or replaced if broken.

It would be highly advantageous, therefore, to remedy the foregoing and other deficiencies inherent in the prior art.

Accordingly, it is an object of the present invention to provide a new and useful framework for supporting a target to be shot.

Another object of the present invention is to provided a framework that is easy to manufacture.

And another object of the present invention is to provide a framework that is easy to assemble and disassemble.

Still another object of the present invention is to provide a framework that may be used for supporting targets having varying size.

Yet another object of the instant invention is to provide a framework that is easy to use.

Yet still another object of the instant invention is to provide a framework that provides unobstructed access to a target.

And a further object of the invention is to provide a new and useful target stand for supporting a target to be shot, the target stand being configured for supporting the target in spaced apart relation to the target stand.

Still a further object of the immediate invention is to provide a framework that may be easily transported from place to place.

Yet a further object of the invention is to provide a framework that may be easily repaired if damaged.

And still a further object of the invention is to provide a framework that is safe.

SUMMARY OF THE INVENTION

Briefly, to achieve the desired objects of the instant invention in accordance with a preferred embodiment thereof, provided is a portable target stand for placement on the ground for supporting a target having an outer perimeter edge. The portable target stand is comprised of a collapsible framework including a collapsible support and a collapsible base. The collapsible support includes a first elongate element having a first stem receiving socket and an upper end, a second elongate element having a second stem receiving socket and an upper end, and an upper transverse brace detachably interconnecting the upper end of the first elongate element to the upper end of the second elongate element. The first elongate element and said second elongate element are disposed in a substantially upright, parallel and spaced apart relation. The first elongate element, the second elongate element, and the upper transverse brace define an outer perimeter defining an unobstructed opening for receiving a target. Further included is an attachment means for perimetrically adjustingly suspending the target within the unobstructed opening in spaced apart relation relative the support.

The base is detachably engagable to the elongate elements for holding the elongate elements in a substantially upright configuration above the ground. The base includes a first pair of legs each having a lower end for resting on the ground and an elevated engagement element, the first pair of legs being disposed in substantially parallel and spaced apart relation. The base further includes a second pair of legs each having a lower end for resting on the ground and an elevated complemental engagement element, the second pair of legs being disposed in substantially parallel and spaced apart relation.

The engagement element of each of the first pair of legs is matingly engagable to the complemental engagement element of each of the second pair of legs to form a first stem and a second stem respectively, the first stem and the second stem disposed in substantially parallel, upright, and spaced apart relation. The first stem receiving socket and the second stem receiving socket are operative for tightly and removably receiving therein the first stem and the second stem respectively to form a pair of strong resilient joints, the first elongate element and the second elongate element being thereby disposed in the substantially upright, parallel, and spaced apart relation.

The attachment means includes a plurality of clamps for detachably engaging the outer perimeter edge of the target within the unobstructed opening, said plurality of clamps being perimetrically adjustably mounted to the outer perimeter for facilitating the suspension of targets having varying sizes within the unobstructed opening. Each clamp is adjustably mounted to the outer perimeter by means of a cord, the cord having a first free end and a second free end detachably coupled to a one of the clamps, a length of the cord intermediate the first free end and the second free end of the cord encircling portions of the outer perimeter of the collapsible support a selected number of times for adjusting the distance between the outer perimeter of the collapsible support and the. With respect to the preferred embodiment, each cord is constructed of a substantially pliant and elastic material for tautly suspending the target within the unobstructed opening.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 5 is an enlarged perspective view of one of the plurality of clamps first illustrated in combination with FIG. 1, the clamp shown having a cord coupled thereto for detachably and adjustably attaching the clamp to the framework;

FIG. 6 is a side view of one of the plurality of clamps shown in FIG. 1, the clamp shown as it would appear interconnecting the support to the target, the cord being coupled to the clamp and encircling portions of the framework; and FIG. 7 is a fragmentary perspective view of one of the plurality of clamps illustrated in FIG. 1, with the cord illustrated FIG. 6 shown wrapped around portions of the framework a plurality of times for adjusting the distance between the clamp and the framework.

DETAILED DESCRIPTION OF THE PREFERRED EMBODIMENT

Figure 1:
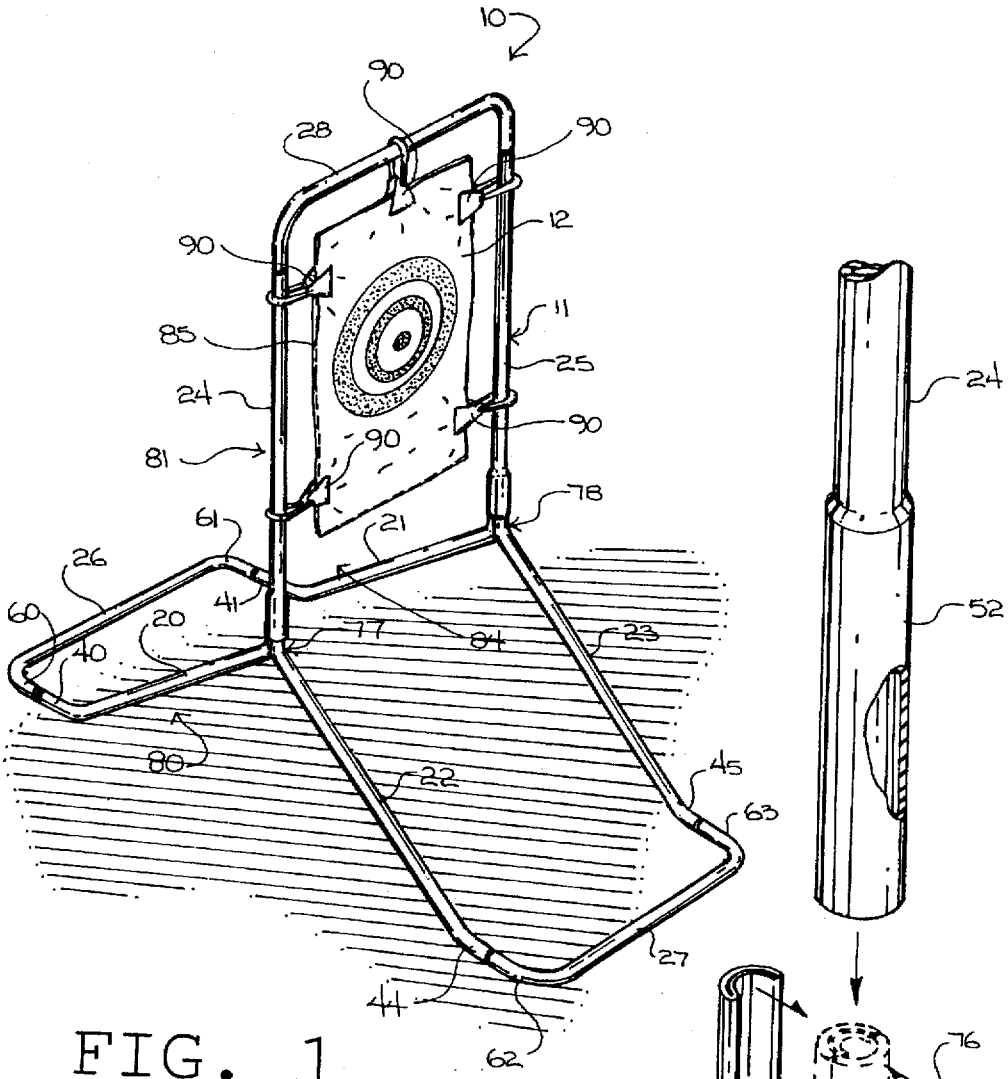
FIG. 1 is a perspective view of a target stand constructed in accordance with the preferred embodiment, the target stand incorporating a collapsible framework for supporting a target with a plurality of clamps, the framework including of a base coupled to a support for supporting the target.

Turning now to the drawings, in which like reference characters indicate corresponding elements throughout the several views, attention is first directed to FIG. 1 which illustrates a first embodiment of the instant invention comprising a target stand being generally designated by the reference character 10. Target stand 10 generally includes a framework 11 for suspending a target 12 above the ground with an attachment means, details of which will be discussed as the detailed description ensues. Target 12 is suspended so as to be shot with a projectile such as an arrow or a bullet. When in use, the normal path of a projectile will be understood as the area directly in front of and in back of target 12. Framework 11 is constructed of a plurality of structural elements that may be easily assembled for use, and disassembled for easy storage when not in use. In addition, target stand 10 is specifically designed so that no part of framework 11 crosses or extends into the normal path of a projectile.

Figures 3, 4:
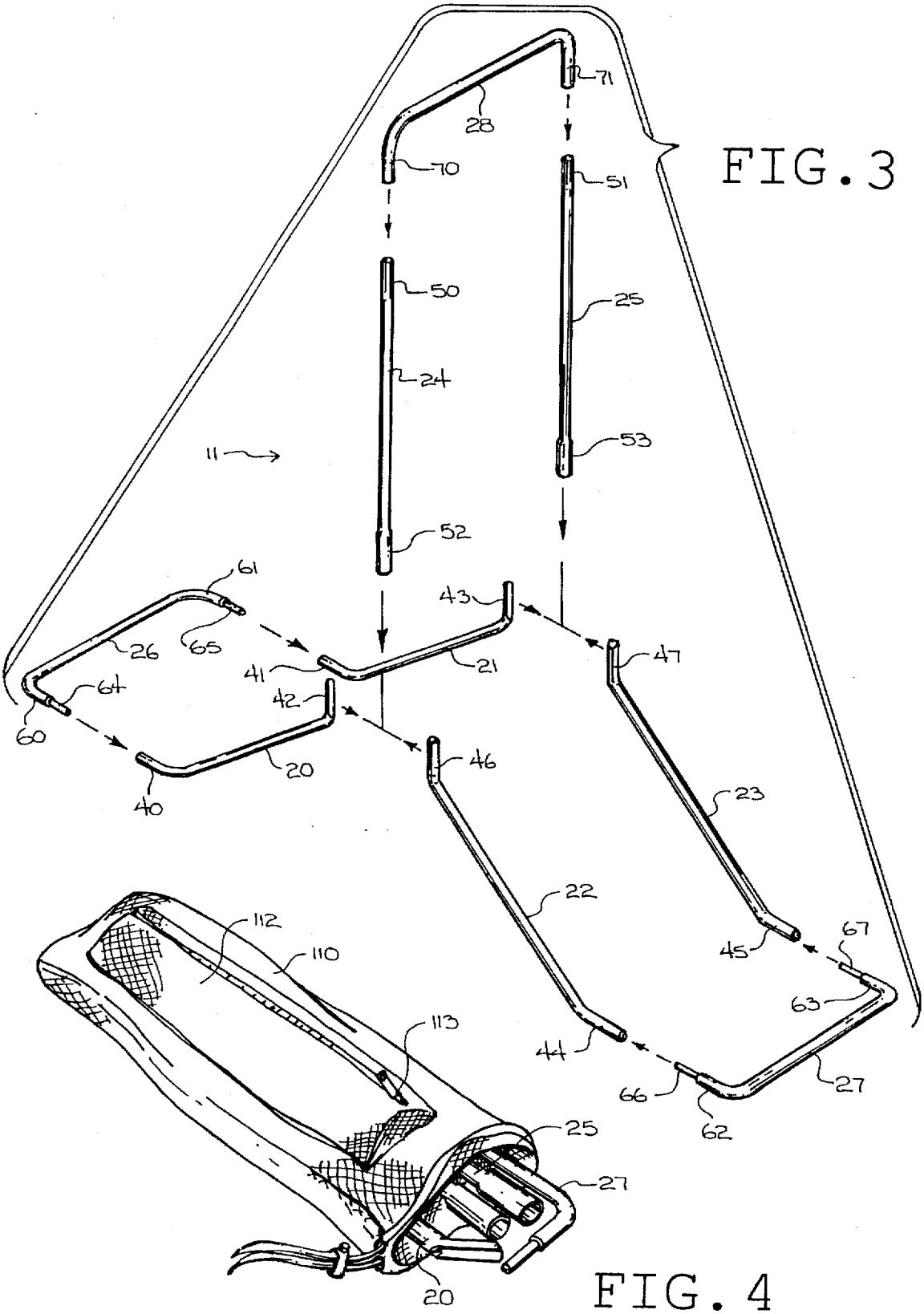
FIG. 3 is an enlarged exploded perspective view of the framework first illustrated in FIG. 1.
FIG. 4 is a perspective view of the framework of FIG. 1 shown disassembled in a collapsed configuration and placed within a storage bag.

Attention is now directed to FIG. 3, which illustrates an exploded perspective view of the various structural elements that when coupled together, form framework 11 illustrated in combination with FIG. 1. In particular, framework 11 is comprised of nine individual detachably or removably engagable elements, including a first pair of legs, 20 and 21, a second pair of legs, 22 and 23, a first elongate element 24, a second elongate element 25, a first transverse brace 26, a second transverse brace 27, and an upper transverse brace 28. Each of the aforementioned parts are tubular and are preferably constructed of plastic, aluminum, or another selected substantially rigid and damage resistant material. Legs 20 and 21 are substantially elongate and each respectively include a lower end, 40 and 41, and an upper end, 42 and 43, disposed in outwardly diverging relation respectively. Legs 22 and 23 are also substantially elongate and each respectively include a lower end, 44 and 45, and an upper end, 46 and 47, disposed in outwardly diverging relation respectively. First and second elongate elements, 24 and 25, include first and second upper ends, 50 and 51, respectively, and first and second lower ends defined by a first stem receiving socket 52, and a second stem receiving socket 53, respectively. First and second transverse braces, 26 and 27, of identical construction, are each substantially elongate and include inwardly extending outer ends, 60 and 61, and 62 and 63, respectively, having axially extending connecting members, 64 and 65, and 66 and 67, respectively. Each of these connecting members, 64, 65, 66, and 67, are comprised of a peg having an outside diameter substantially equal to the inside diameter of the first and second pair of legs, 20, 21, 22 and 23. Finally, upper transverse brace 28 is substantially elongate and includes downwardly extending outer ends, 70 and 71, having an inside diameter substantially equal to the outside diameter of the first and second upper ends, 50 and 51, of the first and second elongate elements, 24 and 25, respectively.

Figure 2:
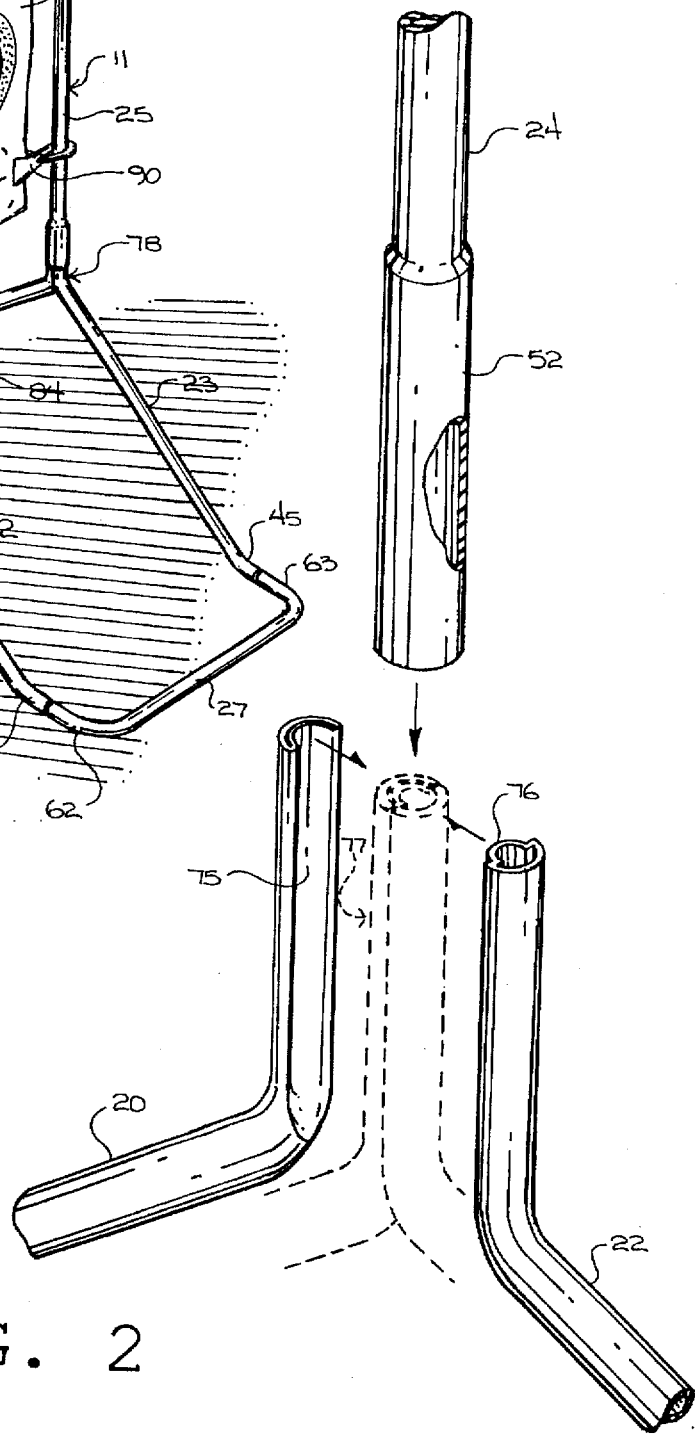
FIG. 2 is an enlarged fragmentary perspective view of an elongate element of the support shown in FIG. 1 as it would appear prior to being coupled to a pair of engagement elements making up portions of the base illustrated in FIG. 1.

Having described the basic structural aspects of the specific elements comprising framework 11 of target stand 10, the manner in which the elements may be coupled together to form framework 11 will now be discussed. In particular, with continuing reference to FIG. 3, the first and second pairs of legs, 20 and 21, and 22 and 23, are brought together so that upper ends 42 and 43 come together and mate with upper ends 46 and 47 respectively, further details of which can be seen in combination with FIG. 2. In FIG. 2, shown is upper end 42 of leg 20, and upper end 46 of leg 22, shown as they would appear in opposing relation prior to being brought together in mating relation. Because the structural aspects of upper ends 42 and 46 are identical to the structural aspects of upper ends 43 and 47, respectively, only the structural aspects of upper ends 42 and 46 will be herein discussed.

Accordingly, as can be seen in FIG. 2, upper end 42 includes an engagement element comprised of an elongate longitudinally extending groove 75 formed along substantially the entire length of upper end 42. Upper end 46 includes a complemental engagement element comprised of an elongate longitudinally extending tongue 76 formed along substantially the entire length of upper end 46. When brought together as shown in FIG. 2, tongue 76 mates within groove 75 forming a first stem 77 having an external diameter. Once first stem 77 is formed, it can then be inserted within first stem receiving socket 52 to form a solid joint. First stem receiving socket 52 includes an internal diameter substantially equal to the outside diameter of first stem 77, thus providing a tight and secure fit. Although not herein specifically discussed, legs 21 and 23, and second elongate element 25 are assembled together in the same fashion, with upper ends 43 and 47 mated together to form a second stem 78 (FIG. 1) which is then inserted within second stem receiving socket 54. The joints thus formed are strong, solid, resilient, do not come apart during use, and are easy to assemble.

The complete assemblage of framework 11 next involves interconnecting lower ends 40 and 41 of first pair of legs 20 and 21, interconnecting lower ends 44 and 45 of second pair of legs 22 and 23, and interconnecting the first and second upper ends 50 and 51 of the first and second elongate elements 24 and 25. This is done with the first and second transverse braces, 26 and 27, and upper transverse brace 28. To interconnect outer ends 40 and 41 of first pair of legs 20 and 21, connecting members 64 and 65 can be inserted into outer ends 40 and 41 respectively. Because the outer diameter of connecting members 64 and 65 are substantially equal to the interior diameter of outer ends 40 and 41, a tight and secure fit is achieved. In like manner, to interconnect outer ends 44 and 45 of second pair of legs 22 and 23, connecting members 66 and 67 can be inserted into outer ends 44 and 45 respectively. Because the outer diameter of connecting members 66 and 67 are substantially equal to the interior diameter of outer ends 44 and 45, a tight and secure fit is similarly achieved. Finally, to interconnect the first and second upper ends 50 and 51 of first and second elongate elements 24 and 25, first and second upper ends 50 and 51 can be inserted into outer ends 70 and 71, respectively of upper transverse brace 28. Because the outer diameter of first and second upper ends 50 and 51 are substantially equal to the interior diameter of outer ends 70 and 71, a tight and secure fit is achieved, thus completing the quick and easy assemblage and formation of framework 11, which then may be placed upon the ground for use as illustrated in FIG. 1.

With reference back to FIG. 1, the first and second pairs of legs, 20, 21, 22, and 23, and the first and second transverse braces, 26 and 27, comprise a base 80 of framework 11. Supported above the ground by base 80 is a support 81 of framework 11, which is comprised of the first and second elongate elements 24 and 25, and the upper transverse brace 28. For placement upon the ground, base 80 is directed towards the ground, with first transverse brace 26 and lower ends 40 and 41 of the first pair of legs 20 and 21 defining a first contact portion for resting upon the ground, and with second transverse brace 27 and lower ends 44 and 45 of the second pair of legs defining a second contact portion for resting upon the ground. The first pair of legs 20 and 21, and the second pair of legs 22 and 23, are each respectively disposed in spaced apart substantially parallel relation, and extend in upwardly converging relation terminating with first and second stems 77 and 78 respectively. First and second stems 77 and 78 are also disposed in a spaced apart, substantially upright and parallel relation, with first and second elongate elements 24 and 25 extending upwardly therefrom in a spaced apart, substantially upright and parallel relation. First transverse brace 26, second transverse brace 27, and upper transverse brace 28, are each disposed at right angles relative the first and second elongate elements 24 and 25, and the first and second pairs of legs, 20, 21, 22 and 23, and define the relative width of framework 11. It will be understood that the width of framework 11 is controlled by the length of the first and second transverse braces 26 and 27, and the upper transverse brace 28, the specific length of each which may be selected according to the needs of the user for varying the width of framework 11 as needed.

With continuing reference to FIG. 1, first and second elongate elements 24 and 25, and upper transverse brace 28 encompass an outer perimeter which defines an unobstructed opening 84 through the plane the outer perimeter defines, across which is placed target 12 or other substantially planar sheet of material. For tautly suspending target 12 within opening 84, provided are a plurality of clamps 90 removably and adjustably coupled to support 81. Clamps are removable engaged to the outer perimeter edge 85 of target 12 so that target 12 is substantially coplanar with the outer perimeter of support 81, and tautly suspended within opening 84.

With attention directed to FIG. 5, although other attachment means may be used, each of the clamps 90 are identical and include a first gripping arm 91 having a gripping edge 91A, and an oppositely disposed second gripping arm 92 having a gripping edge 92A (FIG. 6), pivotally coupled together by means of a pin 93 extending through oppositely disposed pairs of generally centrally disposed brackets 94 and 95 respectively. Pin 93 extends through a compression spring 96 disposed intermediate first and second gripping arms, 91 and 92, and is operative as a biasing means for normally urging the respective gripping edges, 91A and 92A, together for gripping target 12 proximate its outer perimeter edge 85 (FIG. 6).

Clamps 90 are each detachably and adjustably coupled to support 81 by means of a cord 100. Cord 100 includes free ends, 101 and 102, in the form of loops attached to ring members, 103 and 104, detachably engagable to inwardly extending hooks, 105 and 106, carried by first and second gripping arms, 91 and 92, respectively. Cord 100, preferably constructed of a substantially pliant and elastic material, is coupled to support 81 by looping it around support 100, which can clearly be seen in FIG. 6. The distance clamps 90 extend into space 84 may be adjusted by encircling a selected length of cord 100 intermediate the first and second free ends, 101 and 102, around a portion of support 81 a selected number of times thus shortening or lengthening cord 100, thus increasing or decreasing the distance clamps 90 extend into space 84, which can clearly be seen in FIG. 7. Therefore, depending on the needs of the user, and depending on the size of the target, the distance clamps 90 extend within opening 84 may be selectively adjusted by looping cord 100 around portions of support 81 of framework 11 a selected number of times for suspending targets within opening 84 having varying outer perimeters or sizes, from small targets having smaller outer perimeters, to larger targets having larger outer perimeters. In addition, as shown in FIG. 1, when held in place by clamps 90, target 12 is suitably suspended in spaced apart relation relative framework 11, thus minimizing the chance of a projectile hitting and causing potential damage to framework 11. Furthermore, although five clamps 90 are shown in FIG. 1, two coupled to first elongate element 24, two coupled to second elongate element 25, and one coupled to upper transverse brace 28, all cooperating together for suspending target 12, any selected number may be used. Because cord 100 is constructed of a substantially pliant and elastic material, the elasticity maintains the tautness of target 12 when suspended.

Because all of the elements of framework 11 of removably coupled together, framework may be easily dismantled when not in use and stored in a container such as bag 110 illustrated in FIG. 4. Bag 110, shown as having a draw string 111 operative for closing the open end of bag 110, further includes an auxiliary pouch 112 which may be opened and closed by a zipper 113, and which may be used for carrying various selected items such as clamps 90 and the cords 100 used with them, or other items as desired.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

We claim:

1. What is claimed is a collapsible framework for placement on the ground for supporting a target having an outer perimeter edge, said collapsible framework comprising:

a collapsible support defining an unobstructed opening and having a first elongate element having an upper end and a first stem receiving socket, and a second elongate element having an upper end and a second stem receiving socket;

attachment means adapted for adjustingly suspending the target within said unobstructed opening in spaced apart relation relative said support; and a collapsible base operative for holding said collapsible support in a generally upright configuration, said collapsible base including:

a first pair of legs disposed in a substantially parallel and spaced apart relation, each having a lower end for resting on the ground and an elevated engagement element; and a second pair of legs disposed in a substantially parallel and spaced apart relation, each having a lower end for resting on the ground and an elevated complemental engagement element, said engagement element of each of said first pair of legs matingly engagable to said complemental engagement element of each of said second pair of legs to form a first stem and a second stem respectively, said first stem and said second stem disposed in substantially parallel, upright, and spaced apart relation to be tightly and removably received in said first stem receiving socket and said second stem receiving socket respectively.

2. The collapsible framework of claim 1, wherein said engagement element of each of said first pair of legs includes an upper end having an elongate longitudinal groove.

3. The collapsible framework of claim 2, wherein said complemental engagement element of each of said second pair of legs includes an upper end having an elongate longitudinal tongue, each said elongate longitudinal tongue matingly and detachably engagable within each said elongate longitudinal groove respectively.

4. The collapsible framework of claim 1, wherein said collapsible base further includes a first transverse brace for removably interconnecting each said lower end of said first pair of legs.

5. The collapsible framework of claim 1, wherein said collapsible base further includes a second transverse brace for removably interconnecting each said lower end of said second pair of legs.

6. The collapsible framework of claim 1, wherein said collapsible support further includes an upper transverse brace for removably interconnecting said upper end of said first elongate element to said upper end of said second elongate element, said first elongate element, said second elongate element and said upper transverse brace defining an outer perimeter defining said unobstructed opening.

7. The collapsible framework of claim 6, wherein said attachment means includes a plurality of clamps adapted for detachably engaging the outer perimeter edge of said target within said unobstructed opening, said plurality of clamps being perimetrically adjustably mounted to said outer perimeter for facilitating the suspension of targets having varying sizes within said unobstructed opening.

8. The collapsible framework of claim 7, wherein said plurality of clamps are each adjustably mounted to said outer perimeter by means of a cord, said cord having a first free end and a second free end detachably coupled to a one of said clamps, a length of said cord intermediate said first end and said second end of said cord encircling portions of said outer perimeter a selected number of times for adjusting the distance between said outer perimeter and said clamp.

9. The collapsible framework of claim 8, wherein said cord is elastic.

10. What is claimed is a portable target stand for placement on the ground for supporting a target having an outer perimeter edge, said portable target stand comprising:

a support including a first elongate element having a first stem receiving socket and an upper end, and a second elongate element having a second stem receiving socket and an upper end, said first elongate element and said second elongate element being disposed in a substantially upright, parallel and spaced apart relation defining an unobstructed opening therebetween for receiving a target;

attachment means adapted for adjustingly suspending the target within said unobstructed opening in spaced apart relation relative said support; and a base detachably engagable to said elongate elements for holding said elongate elements in a substantially upright configuration above the ground, said base including:

a first pair of legs each having a lower end for resting on the ground and an elevated engagement element, said first pair of legs being disposed in substantially parallel and spaced apart relation; and a second pair of legs each having a lower end for resting on the ground and an elevated complemental engagement element, said second pair of legs being disposed in substantially parallel and spaced apart relation, said engagement element of each of said first pair of legs matingly engagable to said complemental engagement element of each of said second pair of legs to form a first stem and a second stem respectively, said first stem and said second stem disposed in substantially parallel, upright, and spaced apart relation;

said first stem receiving socket and said second stem receiving socket for tightly and removably receiving therein said first stem and said second stem respectively, said first elongate element and said second elongate element being thereby disposed in the substantially upright, parallel, and spaced apart relation.

11. The portable target stand of claim 10, wherein said engagement element of each of said first pair of legs includes an upper end having an elongate longitudinal groove.

12. The portable target stand of claim 11, wherein said complemental engagement element of each of said second pair of legs includes an upper end having an elongate longitudinal tongue, each said elongate longitudinal tongue matingly and detachably engagable within each said elongate longitudinal groove respectively.

13. The portable target stand of claim 10, wherein said base further includes a first transverse brace for removably interconnecting said lower ends of said first pair of legs.

14. The portable target stand of claim 10, wherein said base further includes a second transverse brace for removably interconnecting said lower ends of said second pair of legs.

15. The portable target stand of claim 10, wherein said support further includes an upper transverse brace for removably interconnecting said upper end of said first elongate element to said upper end of said second elongate element, said first elongate element, said second elongate element and said upper transverse brace defining an outer perimeter defining said unobstructed opening.

16. The portable target stand of claim 15, wherein said attachment means includes a plurality of clamps adapted for detachably engaging the outer perimeter edge of said target within said unobstructed opening, said plurality of clamps being perimetrically adjustably mounted to said outer perimeter for facilitating the suspension of targets having varying sizes within said unobstructed opening.

17. The portable target stand of claim 16, wherein said plurality of clamps are each adjustably mounted to said outer perimeter by means of a cord, said cord having a first free end and a second free end detachably coupled to a one of said clamps, a length of said cord intermediate said first end and said second end of said cord encircling portions of said outer perimeter a selected number of times for adjusting the distance between said outer perimeter and said clamp.

18. The portable target stand of claim 17, wherein said cord is elastic.

* * * * *